US007769326B2

(12) United States Patent
Miyoshi

(10) Patent No.: US 7,769,326 B2
(45) Date of Patent: Aug. 3, 2010

(54) DEVELOPING DEVICE, PROCESS CARTRIDGE, AND IMAGE FORMING APPARATUS

(75) Inventor: Yasuo Miyoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 11/950,581

(22) Filed: Dec. 5, 2007

(65) Prior Publication Data

US 2008/0145107 A1 Jun. 19, 2008

(30) Foreign Application Priority Data

Dec. 13, 2006 (JP) ..... 2006-336167

(51) Int. Cl.
*G03G 15/08* (2006.01)

(52) U.S. Cl. ..... 399/254; 399/256

(58) Field of Classification Search ..... 399/254, 399/256, 258, 111

See application file for complete search history.

(56) References Cited

U.S. PATENT DOCUMENTS

| | | | | |
|---|---|---|---|---|
| 5,619,765 | A | 4/1997 | Tokita et al. | |
| 5,638,842 | A | 6/1997 | Tokita et al. | |
| 6,505,014 | B2 | 1/2003 | Aoki et al. | |
| 6,658,227 | B2 | 12/2003 | Oyama et al. | |
| 6,671,484 | B2 | 12/2003 | Miyoshi et al. | |
| 6,721,516 | B2 | 4/2004 | Aoki et al. | |
| 7,035,575 | B2 | 4/2006 | Ikeguchi et al. | |
| 7,181,155 | B2 | 2/2007 | Aoki et al. | |
| 7,209,685 | B2 | 4/2007 | Oyama et al. | |
| 2006/0165440 | A1 * | 7/2006 | Adachi | 399/254 |
| 2006/0198663 | A1 | 9/2006 | Miyoshi et al. | |
| 2006/0228135 | A1 | 10/2006 | Miyoshi | |
| 2007/0140744 | A1 * | 6/2007 | Akedo | 399/254 |
| 2007/0231014 | A1 * | 10/2007 | Noguchi et al. | 399/254 |

FOREIGN PATENT DOCUMENTS

| | | |
|---|---|---|
| JP | 11-24404 | 1/1999 |
| JP | 2000-305359 | 11/2000 |
| JP | 2003-107859 | 4/2003 |

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A developing device capable of improving the fluidity of a developer and alleviating the stress generated in the developer, and a process cartridge and an image forming apparatus that use this developing device. In a connecting portion, there is formed a storage portion for storing the developer, in which the cross-sectional area thereof has width D2 that continuously becomes wider toward the top, compared to the width D1 of the cross-sectional area of an opening portion by which the developer is lifted up from the second screw, and becomes wider than D1 at the central part thereof. Furthermore, the width of the cross-sectional area thereof continuously becomes narrow.

14 Claims, 12 Drawing Sheets

DEVELOPING DEVICE, PROCESS CARTRIDGE, AND IMAGE FORMING APPARATUS

BACKGROUND OF THE INVENTION

1. Field of the Invention

The present invention relates to a developing device, and a process cartridge and an image forming apparatus that use this developing device.

2. Description of the Related Art

In a conventional two-component developing device using a two-component developer consisting of magnetic carrier and toner, by using a developer stirring and transporting member that is disposed within a developer container storing the developer, the two-component developer is stirred, and after the toner concentration is evened out, thus obtained developer is transported toward a developer carrier having magnetic poles therein. In this manner, the developer carrier to which the developer is transported and supplied further transports this developer by carrying it on the surface of the developer carrier, supplies it to an electrostatic latent image formed on an image carrier, and thereby visualizes and develops the electrostatic latent image by means of the toner.

In this case, in the developer stirring and transporting member two screws are disposed parallel to each other such that their transporting directions are opposed to each other, wherein one of the screws supplies the developer to the developer carrier, while the other one draws up the developer stored in the developer container and delivers the stirred developer to the first screw, whereby the developer is circulated. In the course of this circulation, toner stirring is performed.

Furthermore, the developer stirring and transporting member recovers the developer that is used once for development to mix it with the supplied toner. If this mixing is not performed thoroughly, image density unevenness and the like occur, causing an abnormal image. The required stirring ability is determined by relative toner consumption with respect to the developer. The consumption of toner with respect to developer capacity increases when achieving high speed and size reduction, thus it is necessary to further improve the stirring ability.

In the conventional developing device, delivery of the developer between the two screws was not always performed smoothly. The reason is that the force of each screw for transporting the developer acts on the axial directions of the screws, and therefore there is basically no transportation force in the direction of delivery. For this reason, it is necessary to significantly increase the drive torque of the sending screw, but this imposes stress on the developer and thereby causes deterioration in adhesion and the like. Especially when the developer capacity is reduced due to size reduction or the like of the image forming apparatus, the number of times that the developer passes the delivery section between the screws relatively increases, thus the effect of development deterioration or the like becomes significant.

In order to improve such problems, there has been proposed an idea of increasing the screw diameter of an end portion of a screw, applying a force to the developer in a delivery direction, and then properly sending the developer so that decrease in torque and generation of stress in the developer are prevented (see Japanese Published Unexamined Patent Application No. H11-24404).

There is also proposed an idea of increasing the force applied at the time of delivery of the developer by regulating the angles of the screws, and thereby improving the flow of the developer in the delivery section so that the developer can be charged uniformly (see Japanese Published Unexamined Patent Application No. 2003-107859).

However, although these publications describe that the flow of the developer is improved by fulfilling the developer transportation force in the developer delivery direction by improving the screws, the problem is that such improvement of the screws is still not enough to alleviate the stress generated in the developer, thus the fluidity of the developer and uniform charging characteristics cannot be obtained.

SUMMARY OF THE INVENTION

The present invention was contrived in view of such circumstances, and therefore it is an object of the present invention to provide a developing device capable of improving the fluidity of the developer and alleviating the stress generated in the developer, and a process cartridge and an image forming apparatus that use this developing device. 1.

In an aspect of the present invention, a developing device comprises a developer carrier, which rotates while carrying a developer comprising magnetic material and toner and supplies the toner to an electrostatic latent image formed on an image carrier to visualize the electrostatic latent image, a first developer stirring and transporting member, which rotates on a rotation axis centered around a center line parallel to a center line of the developer carrier, and transports the developer, while stirring the developer, in the axial direction of the rotation axis to supply the developer to the developer carrier, a second developer stirring and transporting member, which rotates on a rotation axis centered around a center line parallel to the center line of the developer carrier, and transports the developer, while stirring the developer, in a direction opposite to the direction in which the first developer stirring and transporting member transports the developer, to deliver the developer to the first developer stirring and transporting member, and a developer storage portion, which is provided in a connecting portion for delivering the developer from the first developer stirring and transporting member to the second developer stirring and transporting member, and has a cross-sectional area wider than a cross-sectional area of an opening portion of the connecting portion that transports the developer from the first developer stirring and transporting member.

In another aspect of the present invention, a process cartridge supports an image carrier and a developing device integrally and is detachable with respect to an image forming apparatus main body. The developing device has a developer carrier, which rotates while carrying a developer comprising magnetic material and toner and supplies the toner to an electrostatic latent image formed on an image carrier to visualize the electrostatic latent image, a first developer stirring and transporting member, which rotates on a rotation axis centered around a center line parallel to a center line of the developer carrier, and transports the developer, while stirring the developer, in the axial direction of the rotation axis to supply the developer to the developer carrier, a second developer stirring and transporting member, which rotates on a rotation axis centered around a center line parallel to the center line of the developer carrier, and transports the developer, while stirring the developer, in a direction opposite to the direction in which the first developer stirring and transporting member transports the developer, to deliver the developer to the first developer stirring and transporting member, and a developer storage portion, which is provided in a connecting portion for delivering the developer from the first developer stirring and transporting member to the second developer stirring and transporting member, and has a cross-sectional area wider than a cross-sectional area of an opening portion of the connecting portion that transports the developer from the first developer stirring and transporting member.

In another aspect of the present invention, an image forming apparatus comprises an image carrier for carrying thereon an electrostatic latent image of an image, and a developing device that supplies toner to the electrostatic latent image formed on the image carrier to visualize the electrostatic latent image. The developing device has a developer carrier, which rotates while carrying a developer comprising magnetic material and toner and supplies the toner to an electrostatic latent image formed on an image carrier to visualize the electrostatic latent image a first developer stirring and transporting member, which rotates on a rotation axis centered around a center line parallel to a center line of the developer carrier, and transports the developer, while stirring the developer, in the axial direction of the rotation axis to supply the developer to the developer carrier, a second developer stirring and transporting member, which rotates on a rotation axis centered around a center line parallel to the center line of the developer carrier, and transports the developer, while stirring the developer, in a direction opposite to the direction in which the first developer stirring and transporting member transports the developer, to deliver the developer to the first developer stirring and transporting member and a developer storage portion, which is provided in a connecting portion for delivering the developer from the first developer stirring and transporting member to the second developer stirring and transporting member, and has a cross-sectional area wider than a cross-sectional area of an opening portion of the connecting portion that transports the developer from the first developer stirring and transporting member.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

Figure 1:
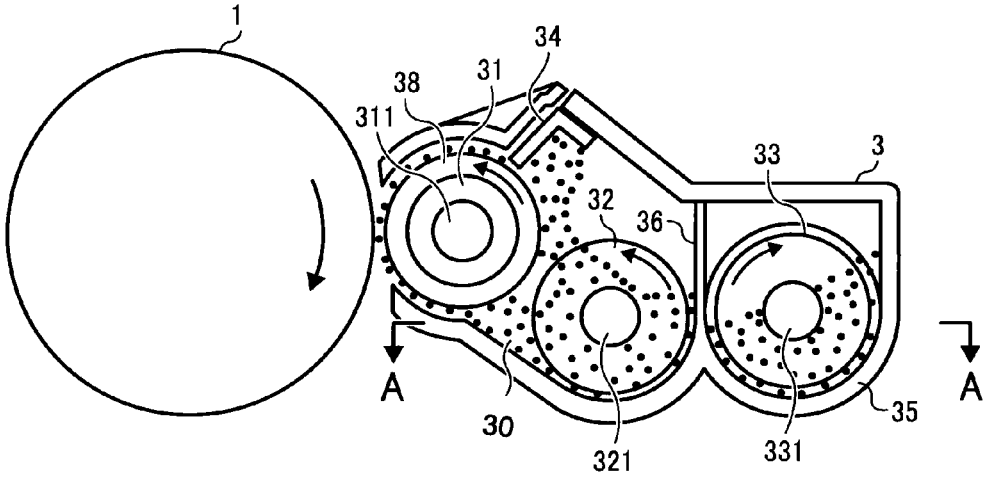
FIG. 1 PRIOR ART
FIG. 1 is a view showing the schematic configuration of a conventional developing device.
Figure 2:
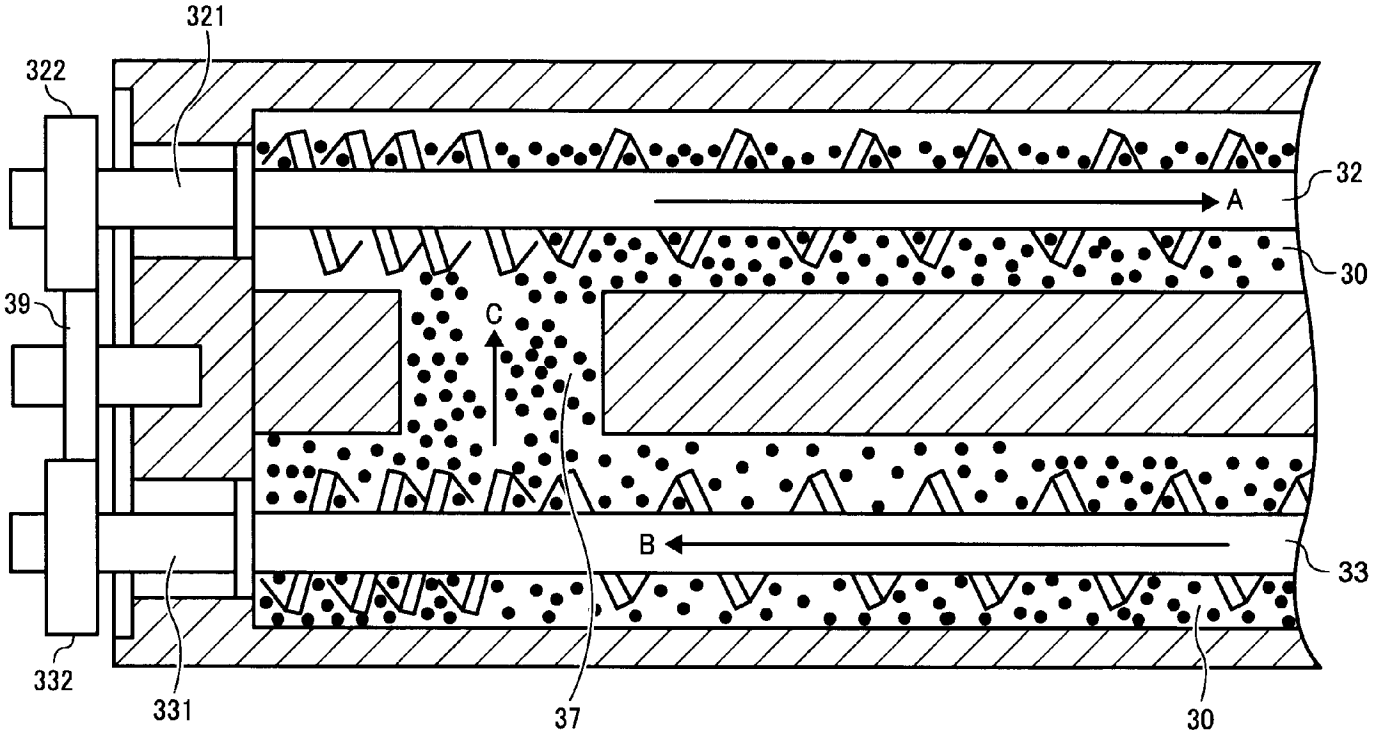
FIG. 2 PRIOR ART
FIG. 2 is a partial cross-sectional view thereof taken along the line A-A of FIG. 1.

First, the conventional developing device is described based on FIG. 1 and FIG. 2 before explaining the developing device of the present invention.

FIG. 1 is view showing a schematic configuration of a developing device used in a conventional electrophotographic image forming apparatus, and FIG. 2 is a partial cross-sectional view thereof taken along the line A-A of FIG. 1. In these drawings, reference numeral 1 represents a photoreceptor drum which is an image carrier carrying on the surface thereof an electrostatic latent image of an image, and reference numeral 3 represents a developing device that stores a developer 30, which is a mixture of a magnetic body and a toner, and supplies a predetermined amount of toner from a developing roller 31 to the photoreceptor drum 1.

The developing device 3 has, within a case 35 for storing the developer 30, the developing roller 31 that has a magnetic roller (not shown), which has fixedly and circumferentially disposed therein a plurality of magnets, and a developing sleeve 38, which is a developer carrier formed of aluminum or other nonmagnetic material and rotated on a rotation axis 311 by the magnetic force of the magnetic roller while carrying the developer 30. The developing device 3 further has a second screw 33 that draws up the developer 30 and transports it while stirring it, a first screw 32 that stirs and, at the same time, transports the developer 30 received from the second screw 33 through a connecting portion 37 located on one end of the second screw 33, to the developing sleeve 38, and a doctor blade 34 that regulates the amount of developer on the developing sleeve 38.

The first screw 32 and the second screw 33 are attached to a side wall of the case 35 so as to be able to rotate on rotation axes 321 and 331, respectively. Further, there is a rotation axis 311 about which rotates the developing sleeve 38. The first screw 32 and the second screw 33 are rotated, in the directions of the arrows shown in FIG. 1, respectively by gears 322 and 332 engaging with a drive gear 39 rotated by a motor, not shown, and stir and transport the developer 30 in opposite directions, i.e., the directions of the arrows A and B respectively, as shown in FIG. 2.

The first screw 32 and the second screw 33 are separated by a partition wall 36. The connecting portion 37 is formed on one end of the partition wall 36, and the developer 30 transported from the second screw 33 is delivered to the first screw 32 by this connecting portion 37, as shown in FIG. 2 (direction of the arrow C). In this manner, the developer 30 is delivered in the conventional developing device, such that the developer 30 is pushed out from both sides of the second screw 33 to thereby spill it upward at the connecting portion 37, and the spilled developer 30 is delivered to the first screw 32 (drawn up). In this method, a strong force acts on the stirring portion of the second screw 33 and on the developer 30 in the vicinity of the wall portion of the connecting portion 37, but this force might impose stress on the developer 30 and thereby causes deterioration in adhesion and the like, since this force cannot be transferred to anywhere.

The present invention has focused attention on the fact that such deterioration in adhesion and the like is caused by the stress imposed on the developer 30 at the connecting portion 37, and therefore has an object of alleviating the stress generated in the developer 30 by forming, in the middle of the connecting portion 37, a storage portion having a cross-sectional area wider than an opening for lifting up the developer 30 of the second screw 33 to the connecting portion 37.

Hereinafter, each of the embodiments of the present invention is described with reference to the drawings.

Embodiment 1

Figure 3:
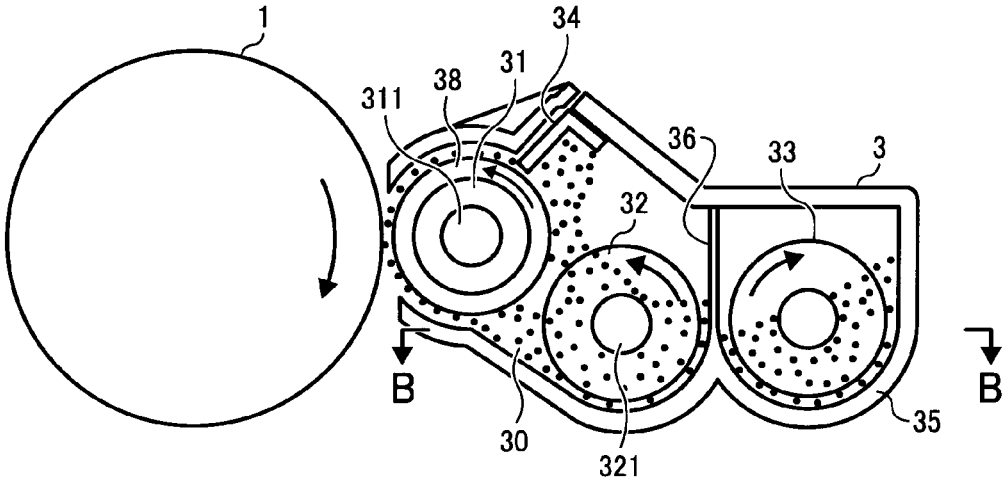
FIG. 3 is a view showing a schematic configuration of a developing device of Embodiment 1 according to the present invention.

FIG. 3 and FIG. 4 are views each showing a schematic configuration of a developing device of an embodiment. The same components as those shown in FIG. 1 and FIG. 2 are applied with the same reference numerals and the descriptions thereof are omitted.

Figure 4A:
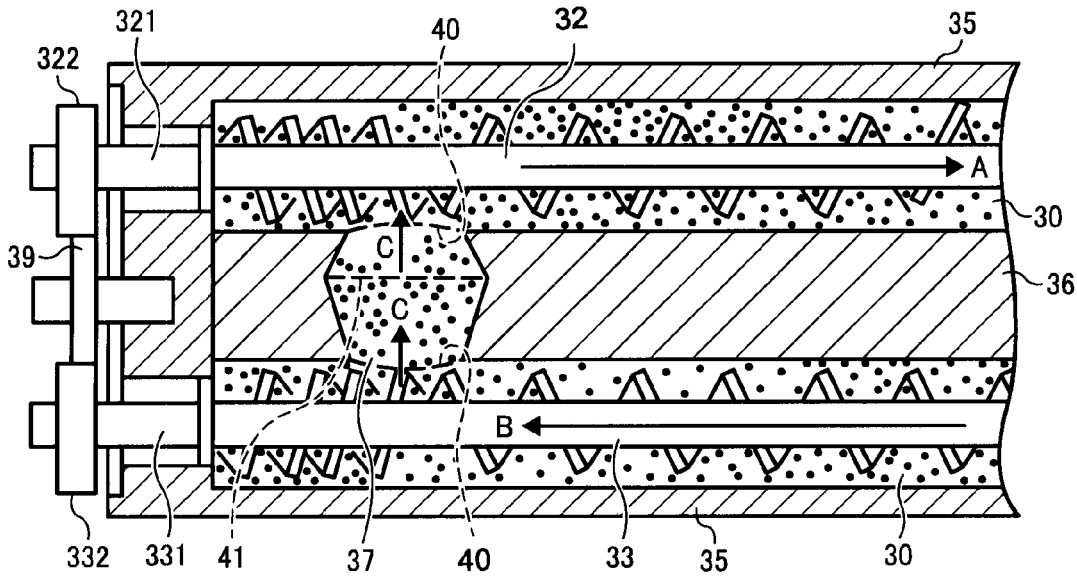
FIG. 4A is a partial cross-sectional view of a substantial part of the present invention, which is taken along the line B-B of FIG. 3.

The present embodiment is different from the above-described conventional developing device shown in FIG. 1 and FIG. 2 in terms of the structure of the connecting portion 37. As shown in FIG. 4A, in the connecting portion 37, there is formed a storage portion 41 for storing the developer 30, in which the cross-sectional area thereof has width D2 that continuously becomes wider toward the top, compared to the width D1 of the cross-sectional area of an opening portion 40 by which the developer 30 is lifted up from the second screw 33, and becomes wider than D1 at the central part thereof. Furthermore, from this storage portion 41, the width of the cross-sectional area thereof continuously becomes narrow, whereby the width of the opening portion 40 at which the developer 30 is delivered to the first screw 32 becomes D3 narrower than D2. Accordingly, the developer 30 that is lifted up at the second screw 33 is dispersed in a fan-like form and stored in the storage portion 41. Thereafter, the developer 30 is sent to the first screw 32 at high transfer speed. It should be noted that in this case D3 is substantially the same as D1, thus the amount of developer supplied from the second screw 33 to the connecting portion 37 is substantially the same as the amount of developer supplied from the connecting portion 37 to the first screw 32.

Therefore, in the connecting portion 37 according to the present embodiment, the opening area of the opening portion 40 on the second screw 33 side is increased in the direction of movement of the developer 30 so that the developer 30 applied with a force can escape in the vicinity of the opening portion 40, whereby deterioration caused by the stress can be prevented. Moreover, compared to the speed of the developer 30 flowing through the center of the connecting portion 37, the speed being X1, the speed of the developer 30 flowing through the outside of the connecting portion 37, X2 through X5, becomes temporarily slow in the direction of movement C. Therefore, the developer 30 flowing to the connector 37 has a velocity gradient. Accordingly, the number of times that the developers contact with each other increases, improving toner dispersibility and achieving stable charging characteristics.

Figure 4B:
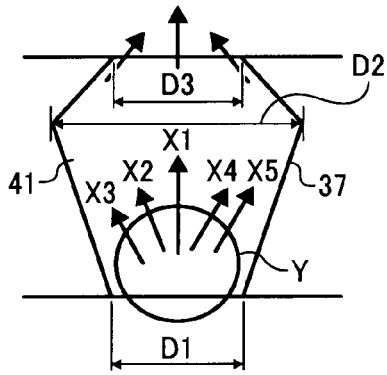
FIG. 4B is a schematic view showing a connecting portion.

Moreover, as shown in FIG. 4B, a strong force acts on the developer in the vicinity of a wall portion (region Y enclosed with a circle) connecting to the second screw 33 and connecting portion 37. However, since the developer 30 flows in a fan-like form, the force is dispersed, reducing the stress applied to the developer 30. In this case, the developer 30 moves not in one direction but in different directions, thus the number of times that carriers contact with each other increases. Therefore, dispersibility of the developer 30 and toner charging characteristics are improved.

Embodiment 2

Figure 5:
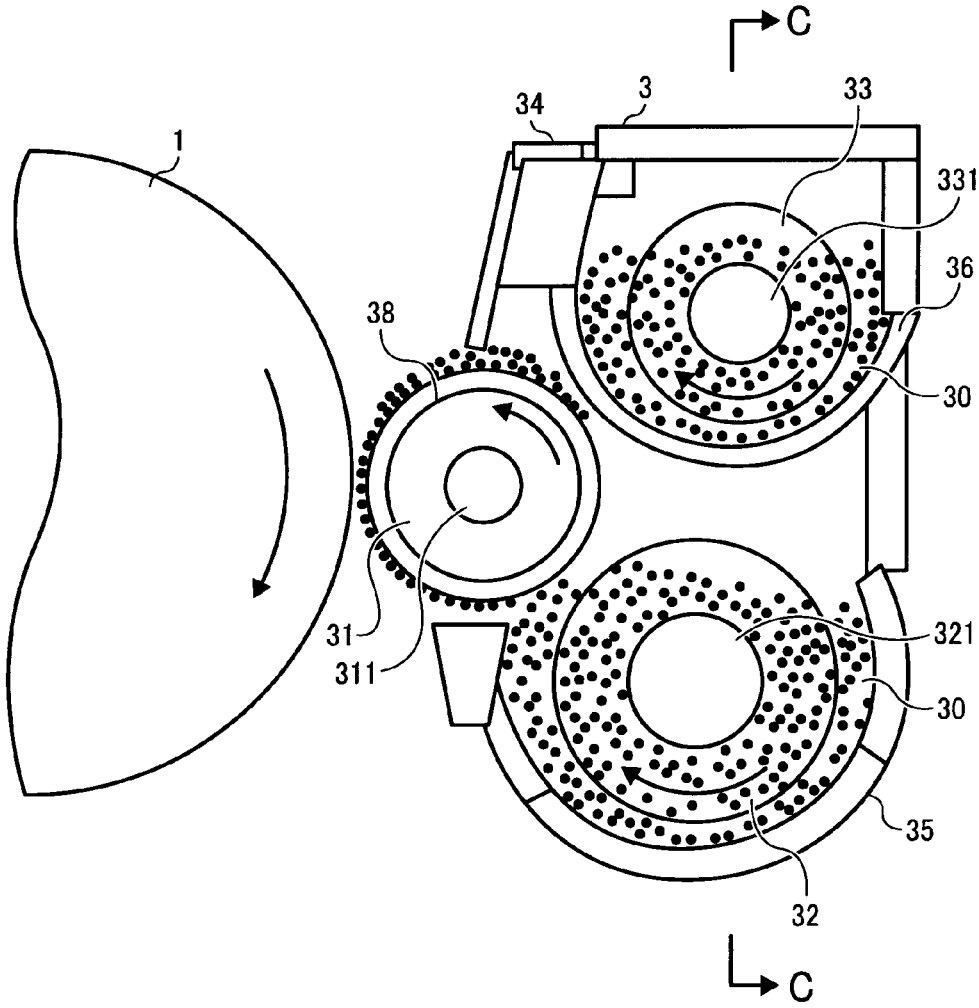
FIG. 5 is a view showing a schematic configuration of a developing device of Embodiment 2 according to the present invention.
Figure 6:
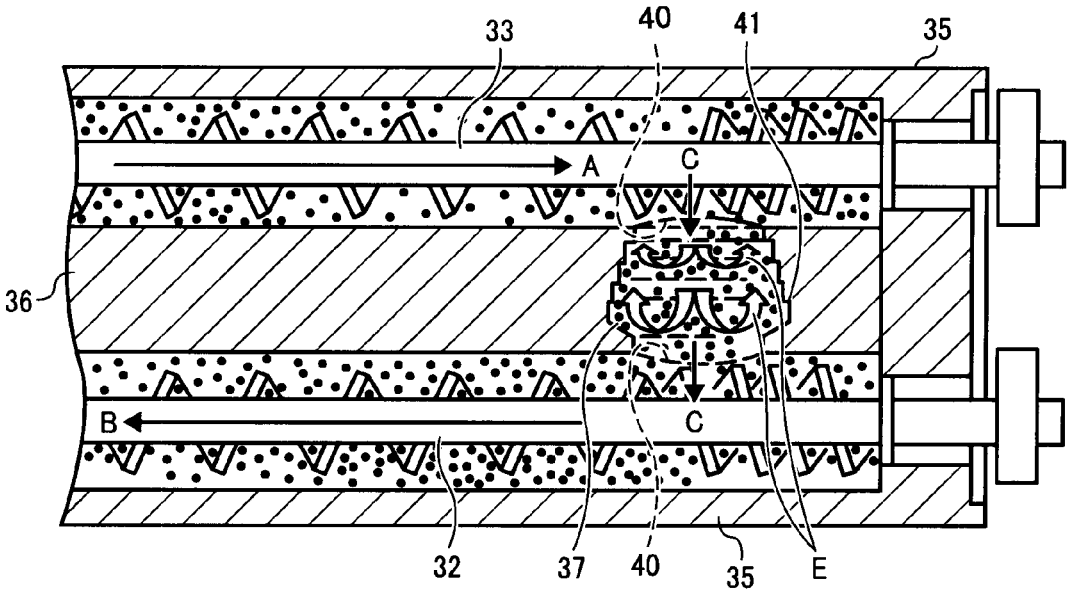
FIG. 6 is a partial cross-sectional view thereof taken along the line C-C of FIG. 5.

FIG. 5 and FIG. 6 are views each showing the developing device of the present embodiment. In FIG. 5 and FIG. 6, the same components as those shown in FIG. 1 through FIG. 4 are applied with the same reference numerals and the descriptions thereof are omitted.

The present embodiment is basically different from the abovementioned Embodiment 1 in that the first screw 32 and the second screw 33 are disposed vertically and in the structure of the connecting portion 37.

In the present embodiment, the first screw 32 and the second screw 33 are disposed vertically so that the space for installing the developing device 3 can be narrowed. Note that new toner is replenished from an opening located above the second screw 33.

Moreover, the structure of the connecting portion 37 is slightly different from that of the connecting portion 37 of Embodiment 1 shown in FIG. 4, such that the cross-sectional area of the opening of the storage portion 41 within the connecting portion 37 gradually becomes wide. By adopting such connecting portion 37, the developer 30 circulates in a manner shown by the arrow E and the speed of the developer 30 can be changed significantly, whereby the developer dispersibility can be improved.

It should be noted that the structure of the connecting portion 37 described in the present embodiment can be applied to the configuration described in Embodiment 1 above in which the first screw 32 and the second screw 33 are disposed horizontally. The structure of the connecting portion 37 shown in FIG. 4 of Embodiment 1 can also be applied to the configuration described in the present embodiment in which the first screw 32 and the second screw 33 are disposed vertically.

Embodiment 3

Figure 7:
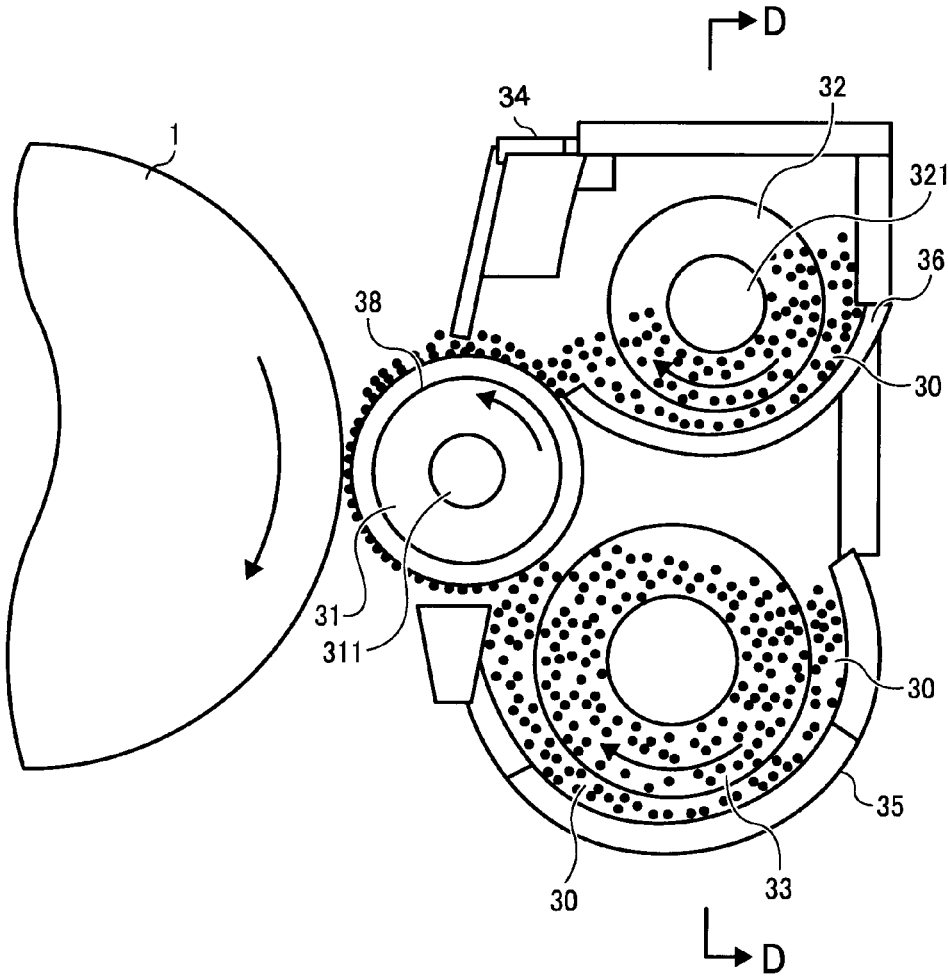
FIG. 7 is a view showing a schematic configuration of a developing device of Embodiment 3 according to the present invention.
Figure 8:
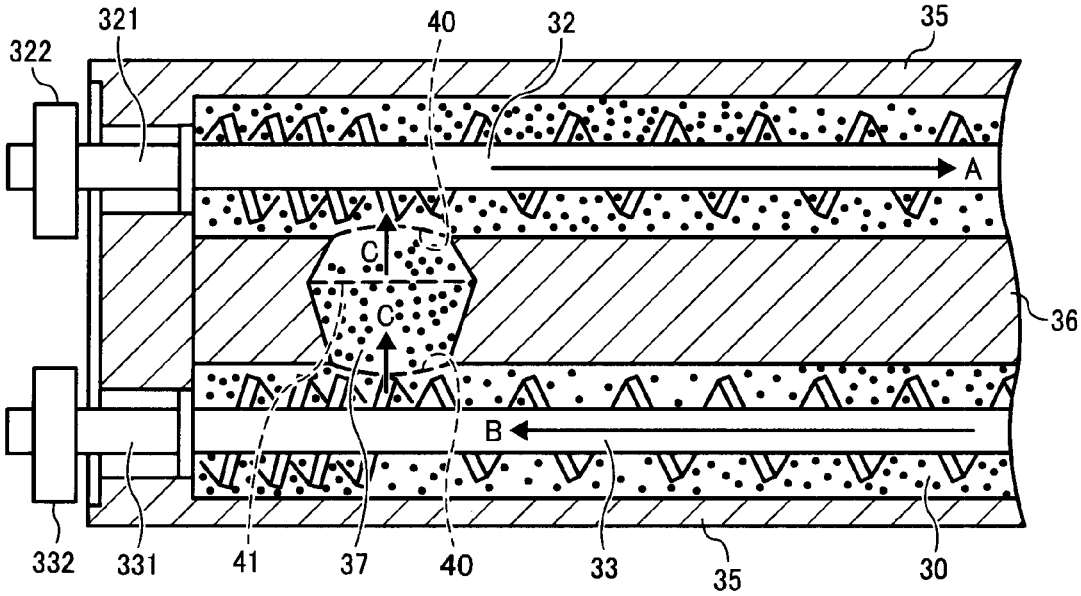
FIG. 8 is a partial cross-sectional view thereof taken along the line D-D of FIG. 7.

FIG. 7 and FIG. 8 are views each showing the developing device of the present embodiment. In FIG. 7 and FIG. 8, the same components as those shown in FIG. 1 through FIG. 6 are applied with the same reference numerals and the descriptions thereof are omitted.

The present embodiment is different from the above-described Embodiment 2 in that the arrangement of the first screw 32 and the second screw 33 is opposite. The developer 30 is drawn up by the connecting portion 37 shown in FIG. 8 from the second screw 33 disposed below to the first screw 32 disposed on the top. In this case, new toner is replenished from an unshown opening located on a side of the second screw 33. Furthermore, after the toner is supplied to the photoreceptor drum 1, residual developer carried on the developing sleeve 38 is separated from the developing sleeve 38 by the magnetic force of the magnets disposed within the developing roller 31 and stored in the vicinity of the second screw 33, whereby the separated developer and newly replenished developer are mixed and stirred by the second screw 33 and then supplied to the first screw 32.

As described above, in the developing device 3 that visualizes an electrostatic latent image formed on the photoreceptor drum 1 and comprises: developer stirring and transporting means, which is configured by the first screw 32 and the second screw 33 stirring and transporting the two-component developer 30 consisting of toner and carrier through the partition wall 36 in opposite directions; the magnets that are disposed parallel to the developer stirring and transporting means and fixed internally; and the developing sleeve 38 that is supported circumferentially and rotatably, the developing sleeve 38 supporting the two-component developer on the surface thereof, the developer stirring and transporting means faces the developing sleeve 38 at an intermediate portion between the first screw 32 and the second screw 33, the first screw 32 is rotatably supported so as to be positioned on a downstream side of rotation of the developing sleeve 38 with respect to the second screw 33, and the magnets draw up the developer 30 from the first screw 32 and drop the developer, which has passed through a developing region facing the photoreceptor drum 1, onto the second screw 33.

In such a developing device, the developer 30 that has passed through the developing region is entirely sent back to the second screw 33, thus the whole of the developer 30 on the first screw 32 side has not been used for development and thus is in a refreshed (initialized) state in which the toner concentration is not reduced. Therefore, the toner concentration on the first screw 32 side is always constant from the upstream side through the downstream side and is not different from the toner concentration on the developing sleeve 38 side, thus an uniform image with good concentration follow-up capability and with no concentration difference can be obtained. Moreover, the developer 30 that is transported to the developing region is drawn up from the first screw 32 after being stirred sufficiently, and then passes through the area facing the doctor blade 34 once, thus the charging conditions are uniform and fluctuation of charge amount is small. Therefore, since the toner is charged evenly, it is possible to form a good-quality image which is free from toner scattering, surface roughness and detailed image variations.

In the developing device 3 according to the present embodiment, the developer 30 supplied to the photoreceptor drum 1 passes through the connecting portion 37 at least once, and charges are applied thereto by using the abovementioned connecting portion 37, whereby the toner having stable charging characteristics is transported to the developing region. Moreover, the density of the toner to be supplied is made uniform, the image quality is stabilized. The charge applying function of the doctor blade 34 can be alleviated by the amount of charges applied in the connecting portion 37 of the present embodiment. Therefore, the stress imposed on the toner can be alleviated by reducing the size of the magnetic field of the doctor blade, and consequently the developing device having stable charging characteristics can be provided for long term use.

Figure 9:
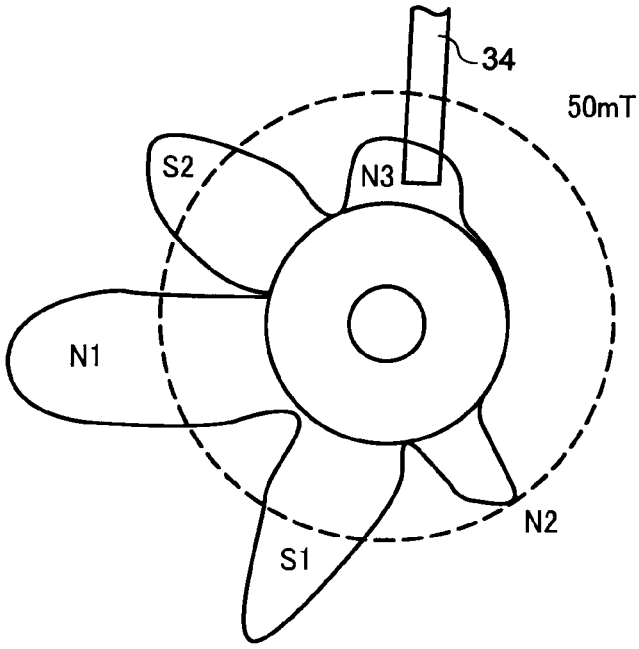
FIG. 9 is a view showing a distribution of normal magnetic flux density of a developing roller of Embodiment 3 according to the present invention.
Figure 10:
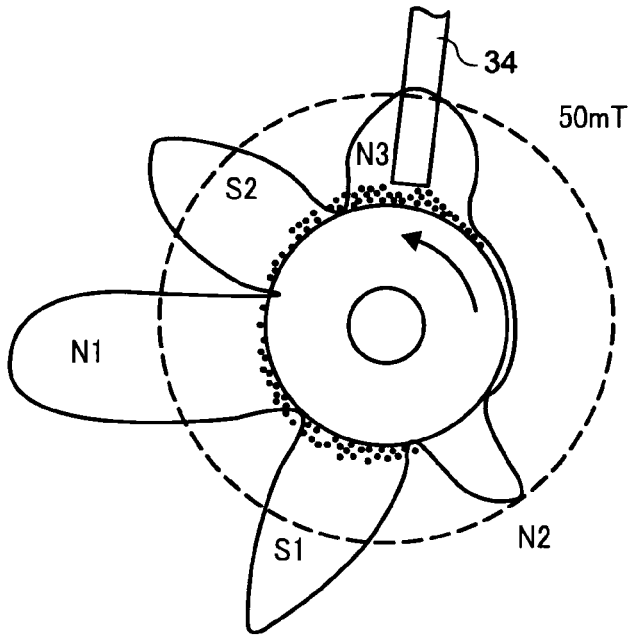
FIG. 10 is a view showing a distribution of the normal magnetic flux density of the developing roller of a comparative example.

To describe specific examples regarding this point, in the present embodiment the distribution of normal magnetic flux density of the magnetic disposed within the developing roller 31 is changed, as shown in FIG. 9 by N1, N2, N3, S1, and S2. Specifically, it was found that if the magnetic force in the position facing the doctor blade 34 shown in FIG. 10 is equal to or less than 50 mT as compared to a comparative example having a magnetic force exceeding 50 mT, good toner charging characteristics can be maintained even when the developing device is used over time. Note that in the present embodiment the diameter of the developing sleeve 38 is 18 mm and the linear velocity thereof is 300 mm/sec.

Figure 11:
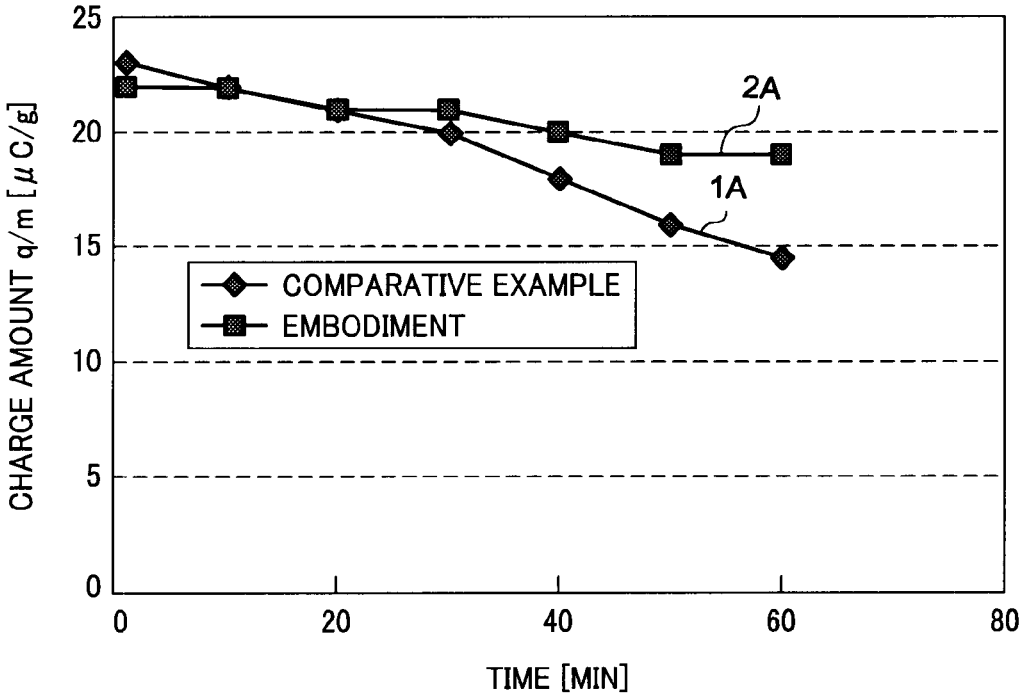
FIG. 11 is a view showing changes in time during which the developing rollers of Embodiment 3 and comparative example according to the present invention are used and in the charge amount of toner.

FIG. 11 is a graph showing changes in the charge amount of the toner when the developing device of Embodiment 3 and the developing device of the comparative example are continuously operated and used. It should be noted that in FIG. 11 the curved lines 1A and 2A are the results obtained in the comparative example and Embodiment 3.

According to these results, when the developing roller 31 that has the normal magnetic flux density distribution of the comparative example shown in FIG. 10 was used, a start-up time for toner charging increases, and good development could not be performed. In Embodiment 3, however, it is clear that good toner charging characteristics can be maintained even if the developing device is used over time.

It should be noted that the toner used in the present invention is preferably a toner in which the degree of circularity (C) of toner particles that is measured by a flow particle image measuring device satisfies an expression: $C>0.96$. If the degree of circularity of the toner to be used satisfies the expression of $C>0.96$, charging can be performed stably, and an image forming apparatus free from fog and toner scattering can be obtained. However, if the degree of circularity satisfy the expression of $C>0.96$, non-electrostatic adhesion force becomes strong, whereby fluidity is deteriorated. Even if such toner is used, the developing device 3 of the present invention can obtain an image having good toner dispersibility and utilizing the original characteristics of the toner.

Embodiment 4

Specific examples in which the developing device of Embodiment 1 is applied to the image forming apparatus are described with reference to FIG. 12.

Figure 12:
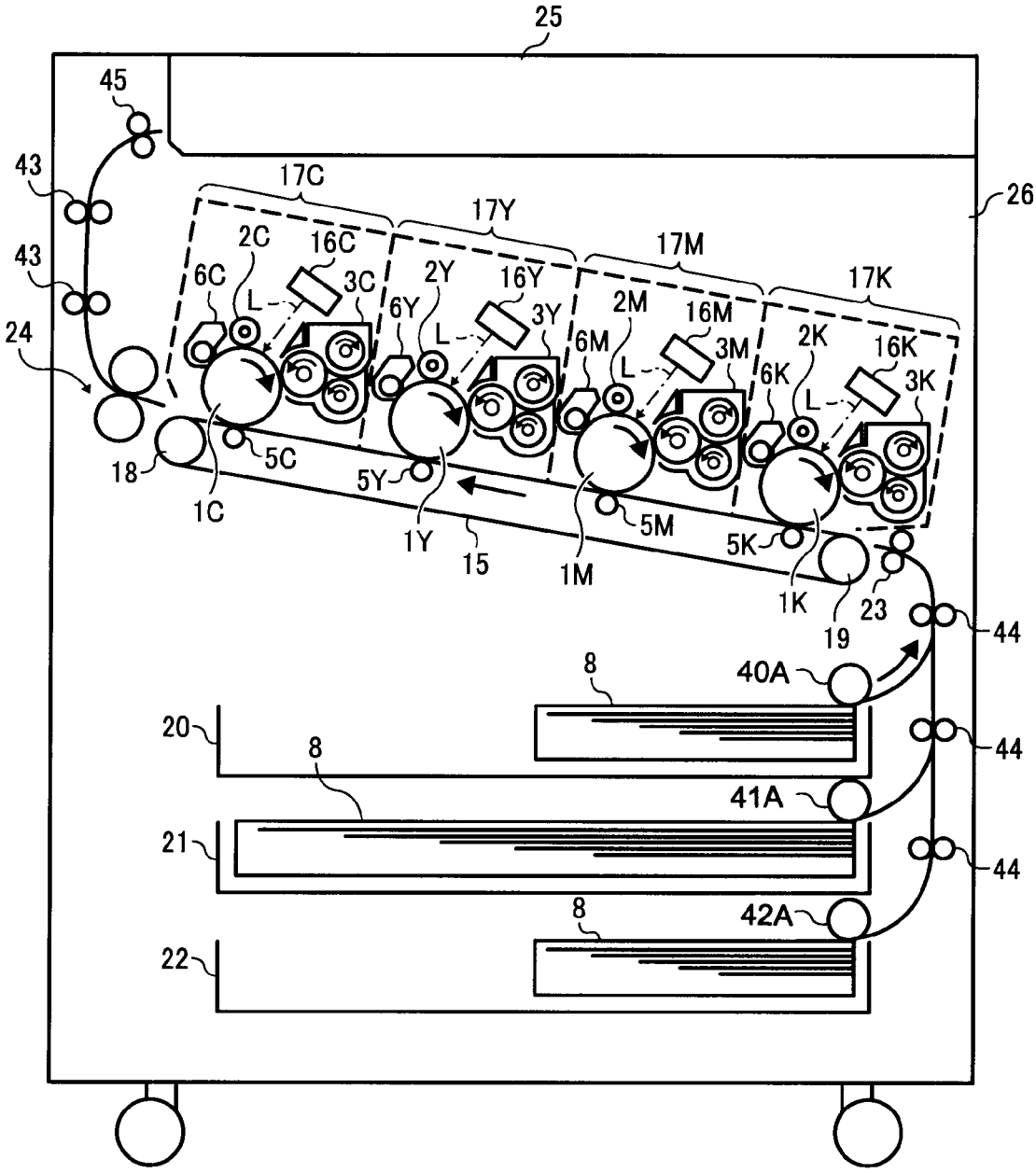
FIG. 12 is a view showing a schematic configuration of an image forming apparatus of Embodiment 4 according to the present invention.

FIG. 12 shows a schematic configuration of the image forming apparatus that has the developing device 3 illustrated in Embodiment 1 of the present invention. The image forming apparatus is a known device, such as a copying machine, a facsimile, a printer and the like, and can be any device as long as it is a type of an image forming apparatus capable of using the developing device to which the present invention is applied. The image forming apparatus of the present embodiment is for forming a color image but may form a one-colored image.

The image forming apparatus can use, as a sheet-like recording medium, any sheets including regular paper that is generally used for copying, OHP sheets, 90K sheets such as cards and postcards, cardboard having a basis weight of 100 $g/m^2$ or more, and so-called special sheets such as envelopes that have heat capacity larger than that of regular paper. These sheets and papers are called "recording medium 8" hereinafter.

The image forming apparatus has image forming units 17C, 17Y, 17M and 17K for forming images of the respective colors according to an original image, primary transfer rollers 5C, 5Y, 5M and 5K disposed facing the image forming units 17C, 17Y, 17M and 17K respectively, paper feeding cassettes 20, 21 and 22 functioning as recording medium supply means for supplying a variety of recording media to transfer regions where the image forming units 17C, 17Y, 17M and 17K face the primary transfer rollers 5C, 5Y, 5M and 5K respectively, and a resist roller 23 for supplying the recording medium 8, which is transported from the paper feeding cassettes 20, 21 and 22, in accordance with the timing for image formation performed by the image forming units 17C, 17Y, 17M and 17K. In FIG. 12, the various parts of the different color image forming units are designated using the same number, with a suffix corresponding to the color of the image forming unit.

The image forming apparatus further has a fixing device 24 for performing fixation on the recording medium 8 having a toner image transferred thereon in at least one of the transfer regions that are the locations where the primary transfer rollers 5C, 5Y, 5M and 5K face the after-mentioned photoreceptor drums 1C, 1Y, 1M and 1K provided in the image forming units 17C, 17Y, 17M and 17K, respectively, and a paper discharge tray 25 disposed in an upper part of the image forming apparatus main body and for stacking the recording medium 8 after it passes through the fixing device 24 and the toner image is formed thereon.

The image forming apparatus further has pickup rollers 40A, 41A and 42A for sending the recording medium 8 from the paper feeding cassettes 20, 21 and 22, a roller pair 44 for transporting the recording medium 8, which is transported from the paper feeding cassettes 20, 21 and 22, toward the resist roller 23, a discharge roller 45 for discharging the recording medium 8 toward the paper discharge tray 25, and a roller pair 43 for transporting the recording medium fixed by the fixing device 24 toward the discharge roller 45.

The primary transfer rollers 5C, 5Y, 5M and 5K are disposed in an oblique direction so that the size of the image forming device can be reduced in the vertical and horizontal directions of the drawing, and a direction of transporting the sheet-like medium is in an oblique direction. Accordingly, in the image forming apparatus the width of a casing 26 in the vertical and horizontal directions of the drawing is slightly longer than the length of an A3-size sheet-like medium in its longitudinal direction. Specifically, the image forming apparatus is significantly downsized to have a minimum required size for storing sheet-like media therein.

The image forming units 17C, 17Y, 17M and 17K are used for developing colors of cyan, yellow, magenta and black respectively. Therefore, although the colors of toners to be used are different, the structures there of are substantially the same, thus the structure of an image forming unit 17K is described to represent the image forming units 17C, 17Y, 17M and 17K. The image forming unit 17K has a known configuration in which are provided a photoreceptor drum 1K as an electrostatic latent image carrier, which is an image carrier, and a charging device 2K, a developing device 3K, a cleaning device 6K and the like that are sequentially disposed in a direction of rotation of the photoreceptor drum 1B, and the photoreceptor drum 1K is exposed to light L from an exposure device 16K between the charging device 2K and the developing device 3K. The electrostatic latent image carrier may be configured in the form of a belt instead of a drum. Note that reference numeral 15 represents a transporting belt for transporting the recording medium 8 stretched tightly by tension rollers 18 and 19.

In this image forming apparatus, a beam that is modulated in response to the black of desired image data is emitted from the exposure device 16K onto the photoreceptor drum 1K to form an electrostatic latent image corresponding to the image onto the photoreceptor drum 1K, and this electrostatic latent image is formed into a toner image by means of the toner supplied from the developing device 3K. The toner image formed on the photoreceptor drum 1K is transferred to the recording medium 8 transported by the transporting belt 15 and thereafter fixed by the fixing device 24.

In this image forming apparatus, the developing device described in Embodiment 1 is used, thus the stress imposed on the developer 30 can be alleviated and thereby a good image can be formed.

Although an example in which the developing device of Embodiment 1 is used is described, the developing devices of Embodiments 2 and 3 can also be used appropriate as the developing device.

Embodiment 5

Figure 13:
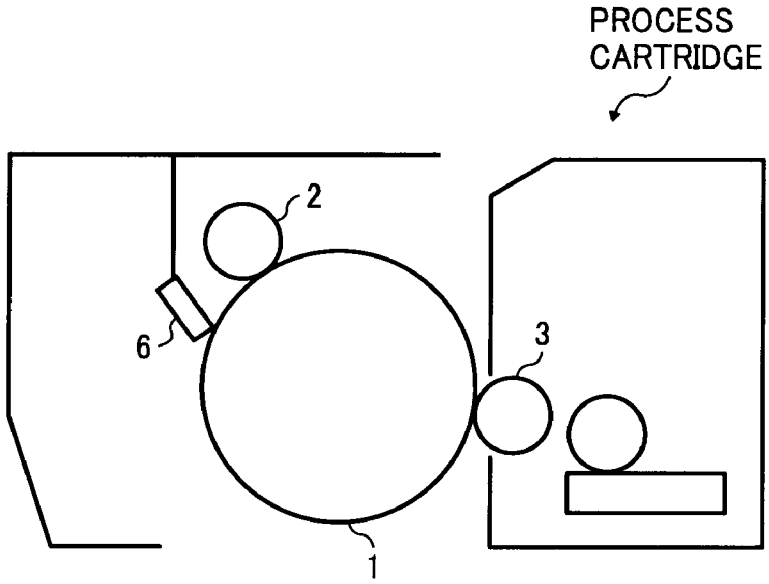
FIG. 13 is a view showing a schematic configuration of a process cartridge of Embodiment 5 according to the present invention.

The present embodiment is a process cartridge in which the developing device of Embodiment 1 is integrated with the photoreceptor drum 1, charging device 2 and cleaning device 6, as shown in FIG. 13. This process cartridge is configured so as to be detachable with respect to the image forming apparatus illustrated in Embodiment 4 above or other image forming apparatus main body such as a copying machine and a printer. In this manner, maintenance does not have to be performed on the charging means 2 and a stable image can be formed.

It should be noted that the process cartridge of the present invention does not have to be provided with all of the photoreceptor drum 1, charging device 2 and cleaning device 6, and it is sufficient that the process cartridge be provided with at least the photoreceptor drum 1 and the developing device 3. On the other hand, the process cartridge of the present embodiment may have another configuration in which, for example, a plurality of components such as transportation substrates are integrated.

According to the present invention, the developing device capable of improving the fluidity of the developer and alleviating the stress generated in the developer, and the process cartridge and image forming apparatus that use this developing device can be provided by adopting the configurations described above.

Various modifications will become possible for those skilled in the art after receiving the teachings of the present disclosure, without departing from the scope thereof.

What is claimed is:

1. A developing device, comprising:

a developer carrier, which rotates while carrying a developer comprising magnetic material and toner and supplies the toner to an electrostatic latent image formed on an image carrier to visualize the electrostatic latent image;

a first developer stirring and transporting member, which rotates on a rotation axis centered around a center line parallel to a center line of the developer carrier, and transports the developer, while stirring the developer, in the axial direction of the rotation axis to supply the developer to the developer carrier;

a second developer stirring and transporting member, which rotates on a rotation axis centered around a center line parallel to the center line of the developer carrier, and transports the developer, while stirring the developer, in a direction opposite to the direction in which the first developer stirring and transporting member transports the developer, to deliver the developer to the first developer stirring and transporting member; and a developer storage portion defined by side walls which are on opposite sides of the developer storage portion, the developer storage portion provided in a connecting portion for delivering the developer from the second developer stirring and transporting member to the first developer stirring and transporting member, the side walls of the opposite sides each being angled such that the developer storage portion has a cross-sectional area wider than a cross-sectional area of an opening portion of the connecting portion that transports the developer from the second developer stirring and transporting member.

2. The developing device as claimed in claim 1, wherein an opening cross-sectional area between the opening portion of the connecting portion and the developer storage portion continuously becomes wider.

3. The developing device as claimed in claim 1, wherein an opening cross-sectional area between the opening portion of the connecting portion and the developer storage portion gradually becomes wider.

4. The developing device as claimed in claim 1, wherein after the toner is supplied to the image carrier, the developer carried on the developer carrier is sent back to the second developer stirring and transporting member.

5. The developing device as claimed in claim 1, further comprising said toner, wherein a degree of circularity of the toner that is measured by a flow particle image measuring device satisfies an expression: Degree of circularity>0.96.

6. The developing device as claimed in claim 1, wherein a cross-sectional area of an opening portion of the connecting portion that transports the developer from the developer storage portion to the first developer stirring and transporting member is narrower than the cross-sectional area of the developer storage portion.

7. The developing device as claimed in claim 1, wherein the first and second developer stirring and transporting members are disposed vertically.

8. A process cartridge that supports an image carrier and a developing device integrally and is detachable with respect to an image forming apparatus main body, wherein the developing device includes:

a developer carrier, which rotates while carrying a developer comprising magnetic material and toner and supplies the toner to an electrostatic latent image formed on the image carrier to visualize the electrostatic latent image;

a first developer stirring and transporting member, which rotates on a rotation axis centered around a center line parallel to a center line of the developer carrier, and transports the developer, while stirring the developer, in the axial direction of the rotation axis to supply the developer to the developer carrier;

a second developer stirring and transporting member, which rotates on a rotation axis centered around a center line parallel to the center line of the developer carrier, and transports the developer, while stirring the developer, in a direction opposite to the direction in which the first developer stirring and transporting member transports the developer, to deliver the developer to the first developer stirring and transporting member; and a developer storage portion defined by side walls which are on opposite sides of the developer storage portion, the developer storage portion provided in a connecting portion for delivering the developer from the second developer stirring and transporting member to the first developer stirring and transporting member, the side walls of the opposite sides each being angled such that the developer storage portion has a cross-sectional area wider than a cross-sectional area of an opening portion of the connecting portion that transports the developer from the second developer stirring and transporting member.

9. The process cartridge as claimed in claim 8, wherein a cross-sectional area of an opening portion of the connecting portion that transports the developer from the developer storage portion to the first developer stirring and transporting member is narrower than the cross-sectional area of the developer storage portion.

10. The process cartridge as claimed in claim 8, wherein the first and second developer stirring and transporting members are disposed vertically.

11. An image forming apparatus, comprising an image carrier for carrying thereon an electrostatic latent image of an image; and a developing device that supplies toner to the electrostatic latent image formed on the image carrier to visualize the electrostatic latent image, wherein the developing device has:

a developer carrier, which rotates while carrying a developer comprising magnetic material and toner and supplies the toner to an electrostatic latent image formed on the image carrier to visualize the electrostatic latent image;

a first developer stirring and transporting member, which rotates on a rotation axis centered around a center line parallel to a center line of the developer carrier, and transports the developer, while stirring the developer, in the axial direction of the rotation axis to supply the developer to the developer carrier;

a second developer stirring and transporting member, which rotates on a rotation axis centered around a center line parallel to the center line of the developer carrier, and transports the developer, while stirring the developer, in a direction opposite to the direction in which the first developer stirring and transporting member transports the developer, to deliver the developer to the first developer stirring and transporting member; and a developer storage portion defined by side walls which are on opposite sides of the developer storage portion, the developer storage portion provided in a connecting portion for delivering the developer from the second developer stirring and transporting member to the first developer stirring and transporting member, the side walls of the opposite sides each being angled such that the developer storage portion has a cross-sectional area wider than a cross-sectional area of an opening portion of the connecting portion that transports the developer from the second developer stirring and transporting member.

12. The image forming apparatus as claimed in claim 11, wherein the image carrier and the developing device are supported integrally within a process cartridge.

13. The image forming apparatus as claimed in claim 11, wherein a cross- sectional area of an opening portion of the connecting portion that transports the developer from the developer storage portion to the first developer stirring and transporting member is narrower than the cross-sectional area of the developer storage portion.

14. The image forming apparatus as claimed in claim 11, wherein the first and second developer stirring and transporting members are disposed vertically.

* * * * *